US007416222B2

(12) United States Patent
Verbruggen et al.

(10) Patent No.: US 7,416,222 B2
(45) Date of Patent: Aug. 26, 2008

(54) FOLDING CARD

(75) Inventors: Antonius Cornelius Verbruggen, JE Haarlem (NL); Geoff Rayner, Hertfordshire (GB)

(73) Assignee: MegaPrint Group Limited, Middlesex (GB)

( * ) Notice: Subject to any disclaimer, the term of this patent is extended or adjusted under 35 U.S.C. 154(b) by 0 days.

(21) Appl. No.: 10/466,389

(22) PCT Filed: Jan. 16, 2002

(86) PCT No.: PCT/GB02/00166

§ 371 (c)(1),
(2), (4) Date: Jul. 16, 2003

(87) PCT Pub. No.: WO02/064378

PCT Pub. Date: Aug. 22, 2002

(65) Prior Publication Data

US 2004/0077471 A1 Apr. 22, 2004

(30) Foreign Application Priority Data

Jan. 17, 2001 (GB) ..... 0101231.9

(51) Int. Cl.
*B42D 15/00* (2006.01)

(52) U.S. Cl. ..... 283/117; 493/405; 283/101; 229/92.8; 156/227

(58) Field of Classification Search ..... 493/405, 493/408, 480, 944, 375; 283/117, 101, 103; 229/92.8, 313, 71, 305; 40/445; 156/227, 156/250; 428/121, 136
See application file for complete search history.

(56) References Cited

U.S. PATENT DOCUMENTS 4,170,355 A * 10/1979 Finkin ..... 273/155
4,613,157 A * 9/1986 Drabish ..... 283/117
4,826,211 A * 5/1989 Sinnott et al. ..... 283/117
5,133,496 A * 7/1992 Davidson et al. ..... 229/92.8
5,359,793 A 11/1994 Copperstone
5,516,033 A * 5/1996 Bernetich ..... 229/92.7
5,564,704 A * 10/1996 Yang ..... 273/155
5,626,551 A * 5/1997 Kearns et al. ..... 493/231
5,735,520 A * 4/1998 Matos ..... 273/155

(Continued)

FOREIGN PATENT DOCUMENTS

EP 0987668 A1 3/2000

(Continued)

OTHER PUBLICATIONS

English Translation of EP0987668 A1.

*Primary Examiner*—Sameh H. Tawfik
(74) *Attorney, Agent, or Firm*—Stephen B Salai, Esq.; Brian B. Shaw, Esq.; Herter, Secrest & Emery LLP

(57) ABSTRACT

A three ply folding card. A method of manufacturing folding cards involving folding two edge portions of a sheet over a central portion to superposition two or three plies of the folding card against each other. A blank for forming folding cards having a plurality of plies of the folding cards positioned on either side of a fold line, one or more of the plies, and its corresponding ply on the other side of the fold line being oriented differently to the other ply or plies. A sheet comprising a plurality of blanks or arrays of plies for forming folding cards.

4 Claims, 12 Drawing Sheets

U.S. PATENT DOCUMENTS

| | | | | | |
|---|---|---|---|---|---|
| 5,759,328 | A | * | 6/1998 | Richwine et al. | 156/227 |
| 5,807,226 | A | * | 9/1998 | Lani Bradley | 493/356 |
| 5,890,647 | A | * | 4/1999 | Petkovsek | 229/92.1 |
| 5,921,547 | A | * | 7/1999 | Wilner | 273/139 |
| 6,019,280 | A | * | 2/2000 | Peterson | 229/305 |
| 6,029,968 | A | * | 2/2000 | Honegger | 270/37 |
| 6,406,581 | B1 | * | 6/2002 | Furst et al. | 156/211 |
| 6,523,826 | B1 | * | 2/2003 | Matos | 273/155 |
| 6,669,235 | B2 | * | 12/2003 | Vijuk et al. | 283/67 |

FOREIGN PATENT DOCUMENTS

| | | |
|---|---|---|
| GB | 164812 | 6/1921 |
| GB | 915581 | 1/1963 |
| GB | 2061816 | 3/1997 |
| GB | 2061817 | 6/1997 |
| GB | 2061818 | 6/1997 |
| GB | 2063717 | 6/1997 |
| GB | 2063718 | 6/1997 |
| GB | 2075495 | 10/1998 |
| WO | WO 0205913 A1 | 1/2002 |

* cited by examiner

FOLDING CARD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "SEQUENCE LISTING"

Not applicable

BACKGROUND OF THE INVENTION

1. Field of the Invention

The present invention relates to a folding card and methods of manufacture of folding cards.

2. Background Art

Folding cards are disclosed in European Patent Application EP-A-0306093, the whole contents of which are incorporated herein by reference. Folding cards may be folded in half a number of times to reveal a four-fold cyclic series of logos, text or pictures, i.e. the card returns to its initial logo, text or picture upon being broken in half a fourth time. Such a folding card functions as a toy or a novelty piece for amusing and informing (e.g. by way of advertising printed on the folding card) a consumer. Due to the four folded states, each presenting a different logo, text or picture, folding cards can be used for extending the amount of information available on the article.

The folding cards disclosed in EP-A-0306093 are initially, i.e. before folding them for a first time or after the fourth fold, hexagonal in shape (see FIG. 8 herein). In alternative embodiments of folding cards, the folding card can have a square shape, as disclosed in United Kingdom Registered Design GB2063718, square with slightly bevelled corners as disclosed in United Kingdom Registered Design GB2061816, or square with rounded corners ad disclosed in United Kingdom Registered Design GB2063717. However, one common problem with all these prior art folding cards is that after the second fold, the substantially regular shape is lost, resulting in a cross shape as shown in FIG. 9 herein. It would therefore be desirable to provide a folding card that maintains a common shape after each fold thereof.

BRIEF SUMMARY OF THE INVENTION

According to the first aspect of the present invention there is provided a three-ply folding card, that is a folding card of the type featuring a cyclic four fold series of folds, formed from three plies of sheet material. All prior art folding cards have been formed by selectively gluing at four distinct corner portions thereof just a first ply to a second ply.

Each ply may itself be a multi-ply sheet.

Preferably, the folding card is formed from a single sheet, folded twice.

Originally, folding cards were made by hand. It involved cutting and scoring two printed sheets for superpositioning against each other and gluing the two pieces together at four distinct corner portions thereof. However, this was found to be ineffective for forming large quantities of folding cards.

Although the above method of manufacture could be automated using conventional paper handling equipment, e.g. an automated calendar press, and this would increase productivity, it would be desirable to further increase productivity.

According to a second aspect of the present invention there is provided a method of manufacturing one or more folding cards comprising the steps of:

a) cutting and scoring a sheet of folding card material to define a first ply of each folding card to be made and a number, corresponding to the number of folding cards, of second plies;

b) selectively applying affixing means to areas of a first side of the sheet for each folding card to be made;

c) folding a first edge portion of the sheet over a central portion of the sheet to sandwich at least part of the affixing means between the first edge portion and at least part of the central portion; and d) folding a second edge portion of the sheet over the central portion of the sheet to sandwich at least part of the affixing means between the second edge portion and at least part of the central portion.

The first fold folds a first ply of one or more folding cards over a second ply of the or each folding card, and the second fold folds one or more third ply into superposition with the or each first and second ply to form one or more folding cards in accordance with the first aspect of the present invention.

A waste portion may be provided around the edge of any part of the central portion and the corresponding part of either or both of the edge portions, or around the edge of any part of corresponding plies. The method of manufacture would then comprise the step of cutting the waste portion away from the folded sheet to form a folding card.

In the absence of a waste portion at the folding lines, a thin trim of the folded sheet may be made to remove the fold or folds from the folding card. Alternatively, the fold lien or lines may be in the form of a deep score-cut in the unfolded sheet for perforating, in use, by a user or a full depth cut extending to the border of the sheet or intermittently across the width of the sheet.

Preferably the first and second fold lines are parallel to each other.

Preferably the folding card is formed of paper or a plastics material.

Preferably the affixing means is an adhesive.

Preferably the plies are pre-printed with logos, text and/or pictures.

The folding of the first edge portion may superimpose one or more first plies over a corresponding number of second plies. Similarly the folding of the second edge portion may superimpose one or more additional first plies over a corresponding number of additional second plies.

The proportions of the edge portions may be varied to produce a different number of folding cards with each fold. For example, the first fold may produce a 16 by 6 array of folding cards and the second fold may produce a 16 by 5 array of folding cards.

Alternatively, the folding of the first edge portion may superimpose a first half of one or more first plies over a first half of a corresponding number of second plies, with the folding of the second edge portion superimposing a second half of the or each first ply over the second half of the or each second ply.

An automated method of manufacturing folding cards involving just a single fold is disclosed in GB23204486, the whole contents of which are incorporated herein by way of reference. This involves folding a single sheet of paper in half to superposition a plurality of first indicia representing a first ply of a two ply folding card over a plurality of second indicia representing a second ply of the two ply folding card and then cutting from the folded sheet a plurality of folding cards.

Firstly, using the method disclosed in GB23204486, a large sheet folding apparatus is required to handle the width of sheet in the fold. Performing two folds, as required in accordance with the second aspect of the present invention, a smaller folding unit can be used.

Secondly, cut lines extend through the indicia to divide the indicia in half. These cut lines are necessary to make the finished folding card work. A waste portion surrounds each indicia to separate the indicia. Without this waste portion, the sheets would potentially fall apart during the fold or would misfeed in the folding machine due to the otherwise inherent lack of sheet stability and integrity. It would be desirable to minimise the size of the waste portion or to remove it altogether.

According to a third aspect of the present invention, there is provided a blank for manufacturing one or more three-ply folding cards, the blank comprising an outermost border surrounding a first ply and a second ply of a folding card, wherein the sheet is folded about a fold line extending between the first ply and the second ply to superposition the first ply against the second ply, the fold line being immediately adjacent an edge of both the first ply and the second ply, the blank also comprising a third ply for the folding card, for superpositioning over the first and second plies. The fold line may be a full depth cut extending the width of the or each folding card (or intermittently thereacross). The blank may need a border extending from one or each side of the or each ply to maintain sheet integrity for the folding step. Alternatively, the fold line may be in the form of a deep score-cut in the unfolded sheet for perforating, in use, by a user.

A plurality of these blanks may be formed in a single sheet.

According to a fourth aspect of the present invention, there is provided a sheet for forming two or more three-ply folding cards, the sheet having two fold lines, two or more first plies of the two or more folding cards on a first side of the fold line, a corresponding number of second plies of the folding cards on a second side of the fold line, a corresponding number of third plies of the folding cards on an opposite side of the second fold line to the first and second plies, corresponding first, second, and third plies being superpositionable against each other upon folding the blank about the fold lines to form folding cards when cut from the folded sheet, wherein one or more of the first plies is oriented differently to the other first ply or plies.

Folding cards may also be manufactured from a drinks mat material. Traditionally, drinks mats are a square or rectangular and formed of an absorbent, usually paper, single-ply material for placing on a table between a glass and the table. They may be decorated with logos, text and/or pictures. By providing drinks mats in the form of folding cards, drinks mats having some secondary function are provided. For forming a drinks mat, preferably the absorbent material is Dalton Drinks Coaster Blotting. The material may be an alternative material, however, having similar absorbency, foldability, strength-when-wet and durability-when-wet characteristics to Dalton Drinks Coaster Blotting. Preferably the affixing means is Gripit 5726, an adhesive. The affixing means may be an alternative adhesive, however, having similar adherence-when-wet and viscosity characteristics to Gripit 5726. Unless suitable materials are used, the drinks mat will either loose its absorbency characteristics, i.e. its function as a drinks mat, or the use of the folding card function would result in the drinks mat rapidly deteriorating or quickly falling apart upon being folded.

BRIEF DESCRIPTION OF THE SEVERAL VIEWS OF THE DRAWING(S)

The present invention will now be described by way of example with reference to the accompanying drawings in which.

Figure 20:
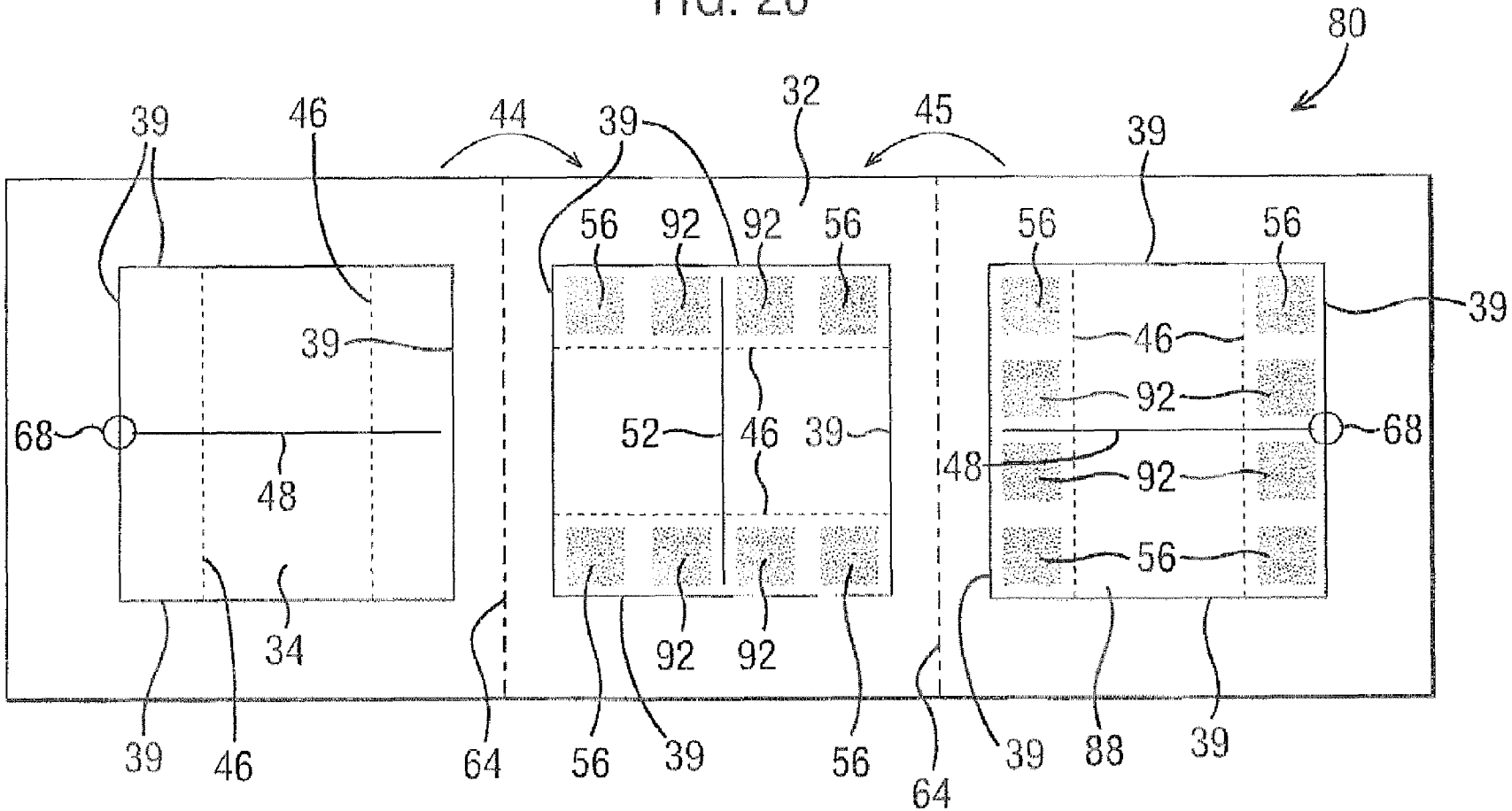
Figure 21:
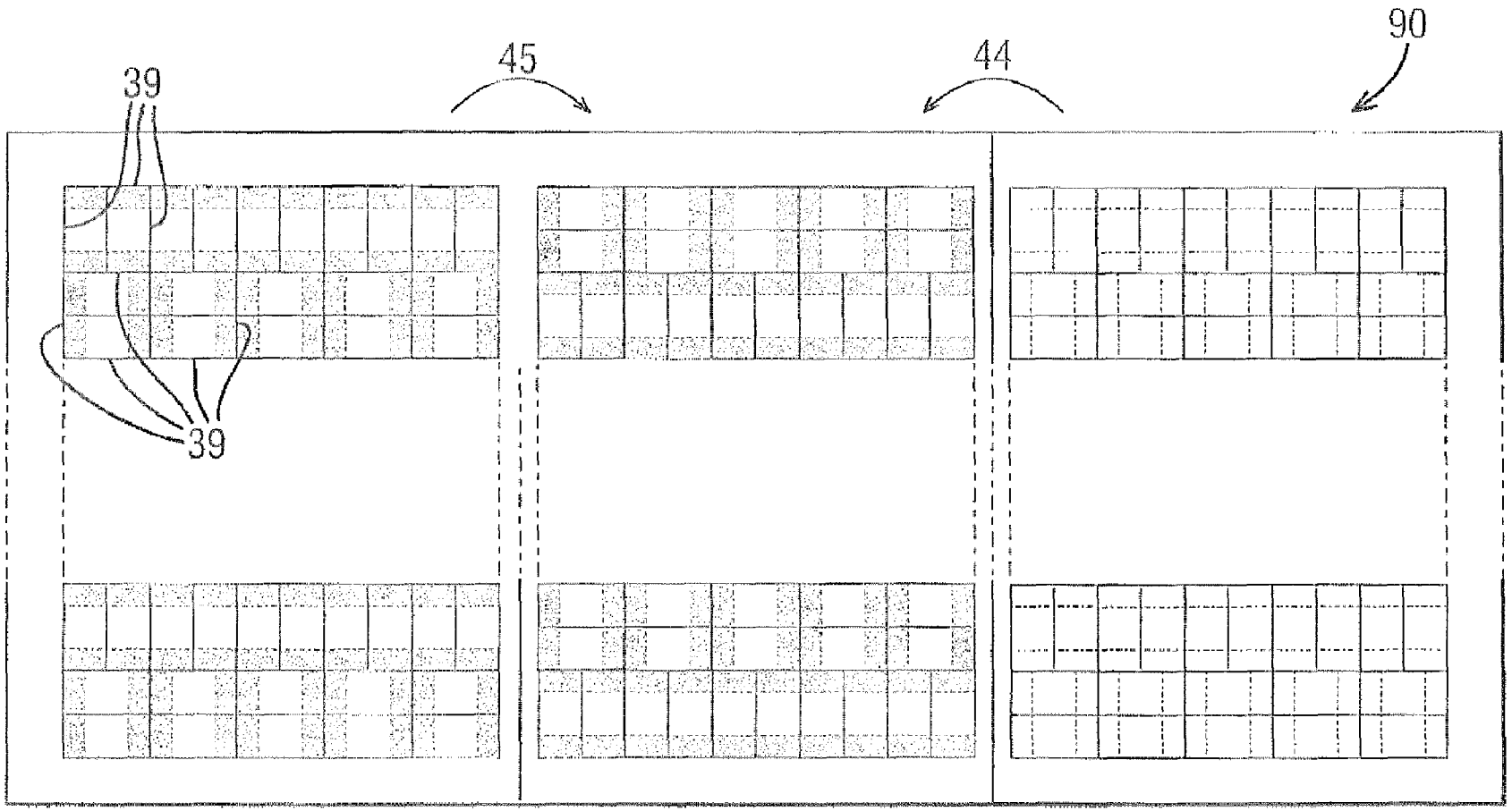

FIG. 20 shows a blank in accordance with the third aspect of the invention for forming a folding card in accordance with the first aspect of the present invention using the method of the second aspect of the present invention; and FIG. 21 shows an arrangement of a sheet in accordance with the fourth aspect of the present invention for forming a plurality of folding cards in accordance with the first aspect of the present invention using the method of the second aspect of the present invention.

DETAILED DESCRIPTION OF THE INVENTION

Figure 1:
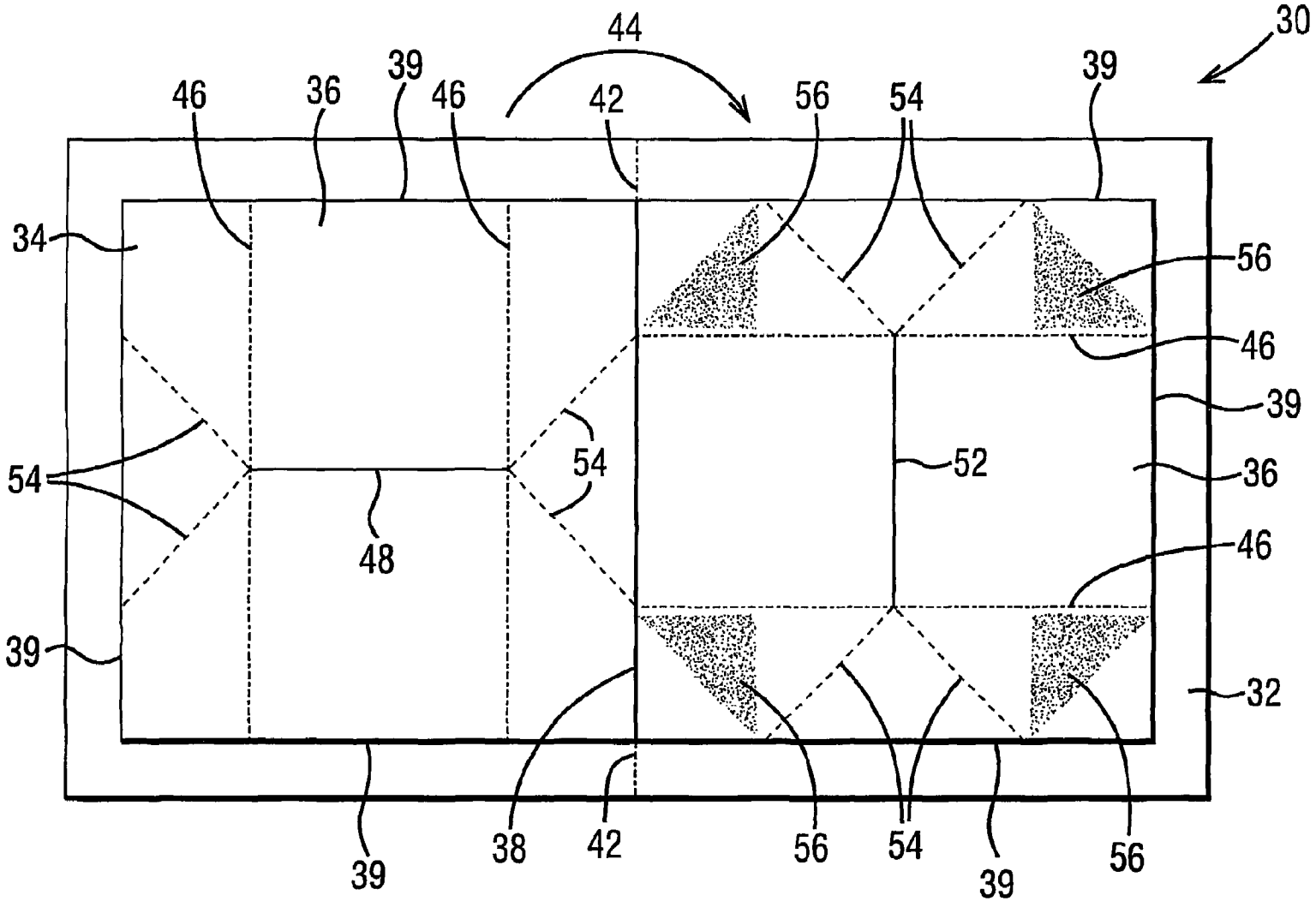
FIG. 1 shows a blank not according to the present invention for use in forming a hexagonal folding card.
Figure 2:
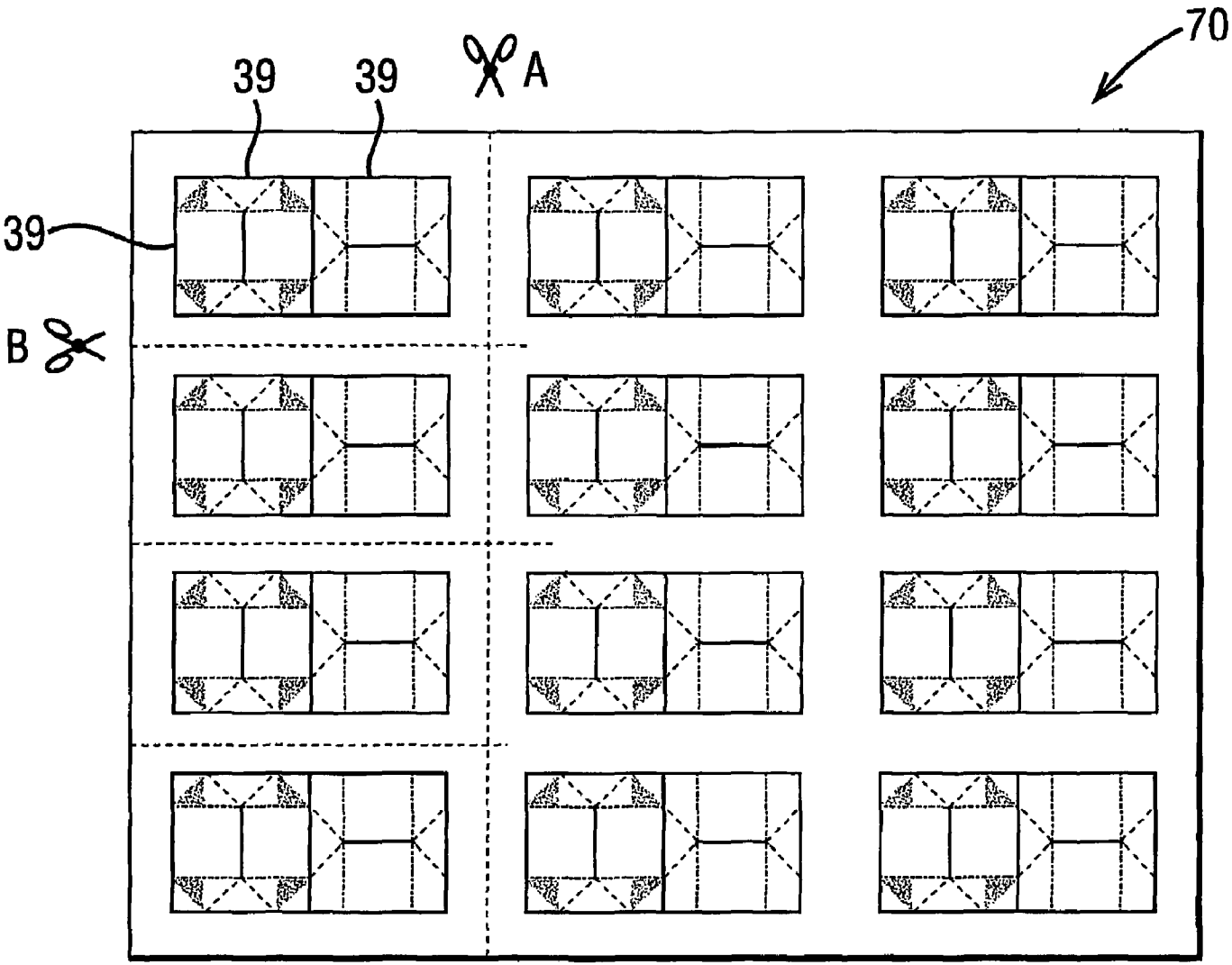

Referring to the drawings, FIGS. 1 and 2 show blanks 30 not in accordance with the present invention. A single blank is shown in FIG. 1, whereas twelve blanks are shown on a single sheet 70 in FIG. 2. A different number of blanks could, of course, be provided.

Figure 7:
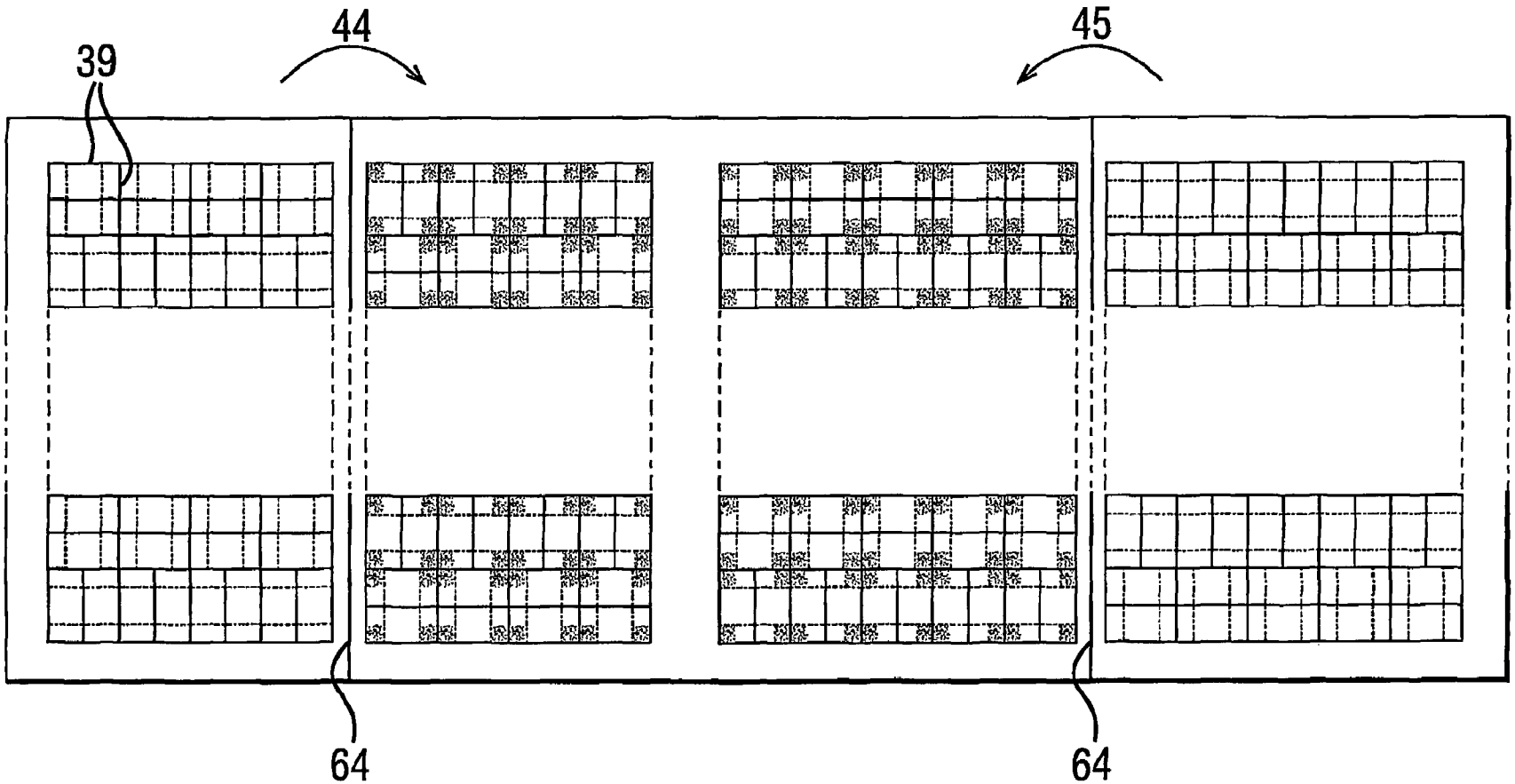
FIG. 7 shows a sheet not in accordance with the present invention.
Figure 8:
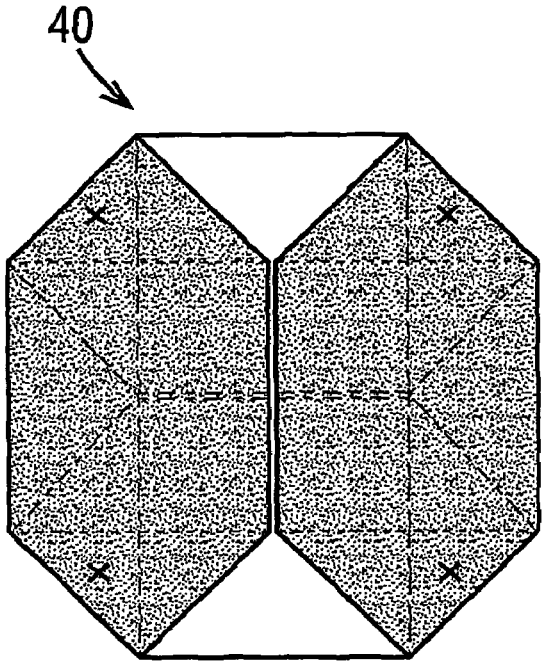
FIG. 8 Prior art
FIG. 8 shows a prior art, hexagonal, two ply folding card.

Each blank in both FIG. 1 and FIG. 2 has a border 32 extending around three sides 39 of a pair of plies 34, 36 of a hexagonal folding card 40 (as shown in FIG. 8). The fourth sides of each pair of plies are coterminous and are defined by a cut line 38. Note, however, that although the sides 39 in these two Figures, and in FIGS. 3, 6, 7, 20 and 21, are shown as continuous lines, these lines would not be present as cuts or score lines on the sheets or blanks before folding, otherwise the sheets or blanks would fall apart. They could, however, be part of a design printed onto the sheets or blanks. They are merely shown in these Figures for clarity.

Extending outwardly from each end of the cut line 38 are fold lines 42, co-linear with the cut line 38. The fold lines 42 extend across the border 32. The cut line 38 and fold lines 42 together define an axis for folding 44 a first ply 34 of the pair over the second ply 36.

The blank has folding card fold lines 46 as defined in GB2320446. A detailed explanation of these is not necessary. However, they may be in the form of score lines, perforations or intermittent cut lines.

However, unlike in GB2320446, the perpendicular cut lines 48, 52 extend only part-way across the width and length, respectively, of the two plies 34, 36. The perpendicular cut lines 48, 52 extend from the centre of each ply 34, 36, outwardly to a point halfway to the sides thereof. Thereafter, perpendicular pairs of perforations 54 extend symmetrically from the cut lines 48, 52 to the edges on the two plies 34, 36. These perforations define rip-offs in the finished folding card so that a hexagonal shape is achieved not only initially (which corresponds with the fourth fold), but also after the first and third folds of the folding card.

After folding 44 the blank 30, a hexagonal folding card 40 is cut therefrom. This involves trimming off the border 32 and corners of the folding card. To avoid wastage of adhesive, before folding the card, triangles of adhesive 56, rather than squares as disclosed in GB2320446, are applied to the blank 30. By slightly extending the area of adhesive 56 into the trimmed off portions of the corners (which are trimmed off to form a hexagonal folding card 40) and pressing the folded blank 30 before trimming, a clean, laminated edge for the finished folding card 40 is achieved.

Referring now to FIG. 2, each blank may be cut from the sheet 70 by cutting along cut lines A and B, stacked and then folded in a folding machine. Alternatively, a strip of blanks may be cut from the sheet (e.g. along cut line A) and folded as a group (folding four blanks at a time in the illustrated embodiment).

Figure 3:
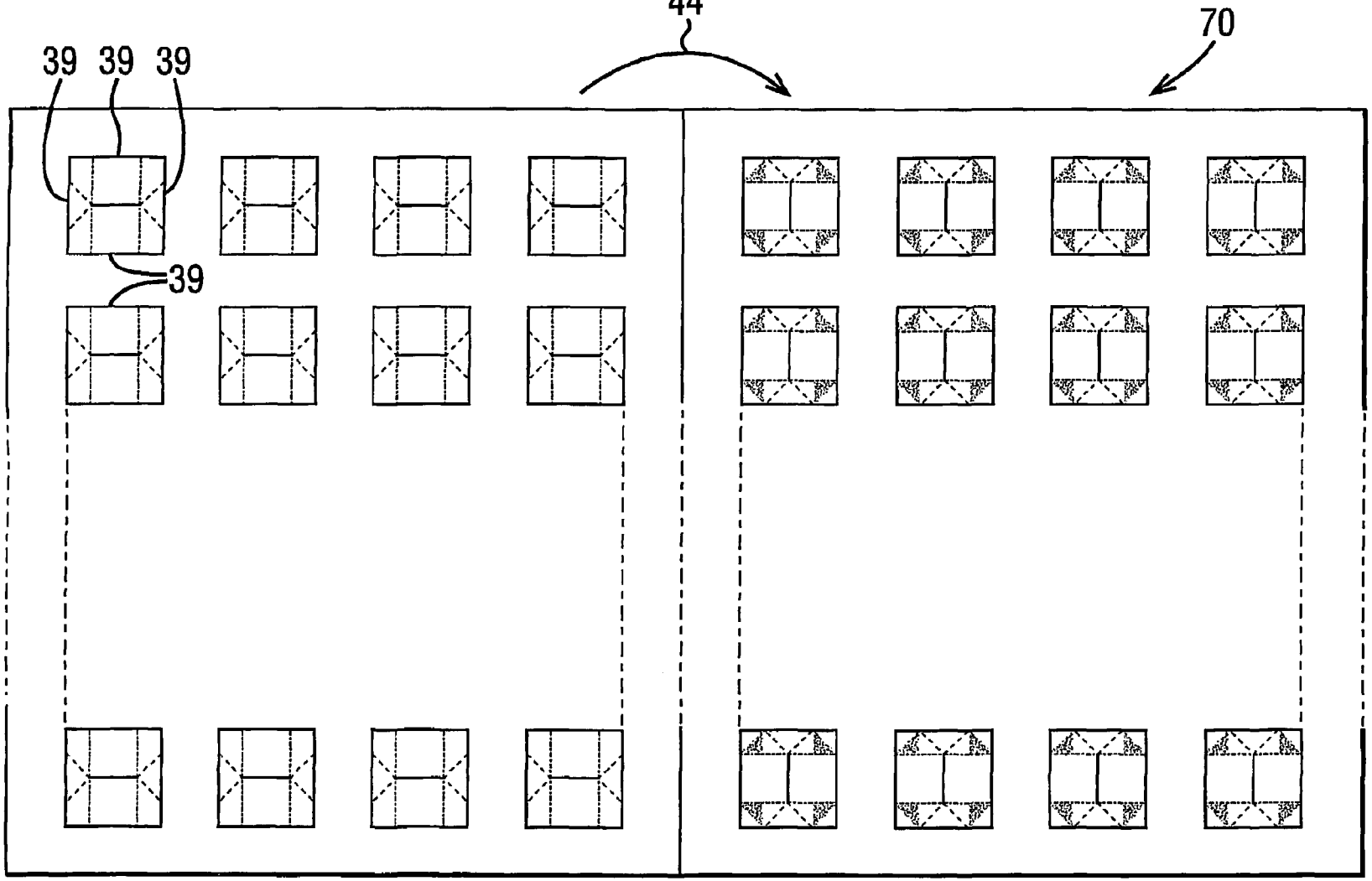
FIG. 3 shows an alternative arrangement of a sheet for forming a plurality of folding cards not in accordance with the invention.

The sheet 70 shown in FIG. 3 is also for making folding cards of (initially) a hexagonal shape (as disclosed in EP-A-0306093 and shown in FIG. 8). It operates under the principles disclosed in GB2320446, although the fold lines and pre-cuts are as described above. Further discussion thereof is not required.

The length of the cut lines 48, 52 and the shape of the perforations 54 shown in FIGS. 1 to 3 can be altered to achieve different shapes of folding card in use, e.g. after the first and third folds of the folding card.

To form a square shape after the first and third folds, the two perpendicular cut lines are extended to the edges of the plies and the glue fills out to the corners. Additionally, the perforation lines are removed. Such an arrangement is shown in GB2320446 and FIGS. 6 and 7 herein.

Of course, the initial shape of the finished folding card, and therefore the shape after the fourth fold, is defined by the trimming step.

Figure 4:
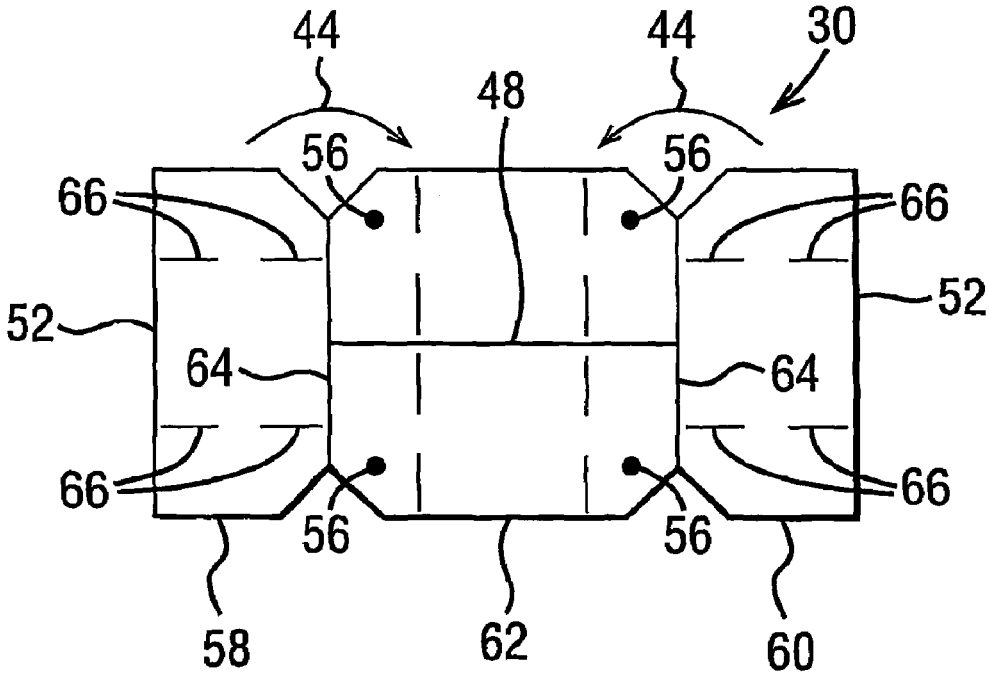
FIG. 4 shows an alternative blank for forming a hexagonal folding card not in accordance with the present invention.
Figure 5:
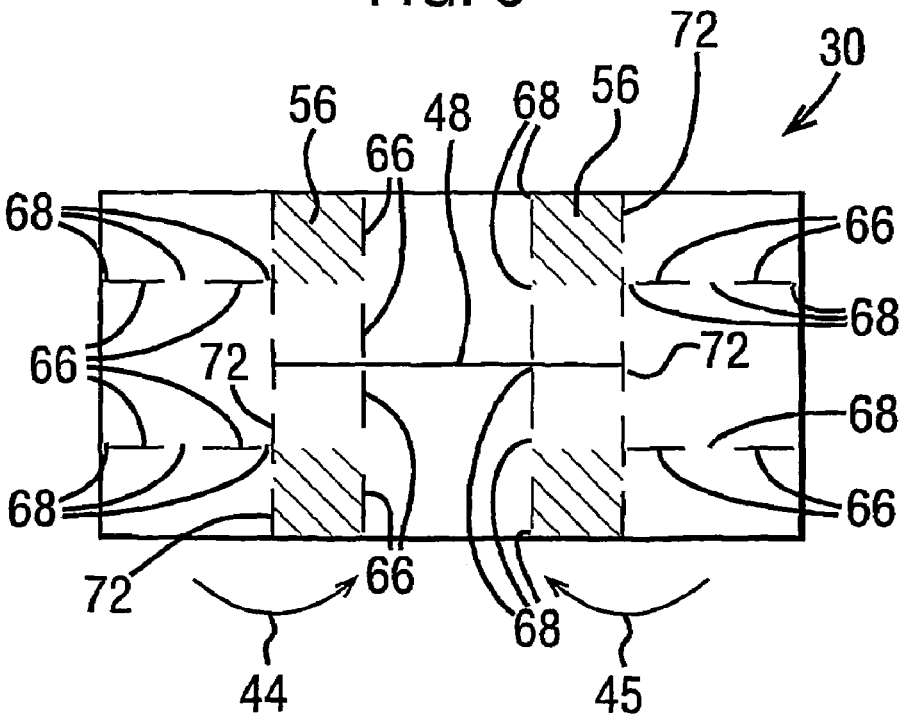
FIG. 5 shows a blank for forming a square folding card not in accordance with the present invention.

Referring now to FIGS. 4 and 5, blanks not in accordance with the present invention for use in a method of manufacturing folding cards not in accordance with the present invention are shown. FIG. 4 shows a blank 30 for a folding card having bevelled corners and FIG. 5 shows a blank 30 for a square folding card.

To form the folding card, two folds 44, 45 are required. This is because instead of a fold 44 of the blank 30 folding an entire ply over another ply of a folding card, each fold folds half 58, 60 of a ply over a corresponding half of a full ply 62.

As illustrated in both FIGS. 4 and 5, the folding card fold lines are each a pair of slots 66 cutting all the way through the blank 30, with uncut spacings 68 therebetween, at the edges of the blank, next to the two fold lines 64 and next to the first perpendicular cut line 48. (The second perpendicular cut line 52 is defined by the two outermost edges of the two ply halves 58, 60.)

The adhesive 56 for adhering the two plies 56, 60; 62 together can be provided, for example, in a spot, as shown in FIG. 4, or as a printed covering as shown in FIG. 5.

The fold axes (fold lines 64) for each fold 44 of the blanks 30 is shown in FIG. 4 as a continuous score line, whereas in FIG. 5, the aces are defined by intermittent slots 72. These fold axes, or fold lines 64, are immediately adjacent an edge of both the first ply 58, 60 and the second ply 62.

After folding, and once the adhesive 56 has taken effect to secure the two plies 56, 60; 62 together, if the score lines are insufficiently deep or the slots 72 are insufficiently long or continuous to allow separation of the plies at the unglued portions to effect a first fold of the four step cyclic fold function of the folding card, a trim step is required to remove the fold lines 64.

The material from which the folding cards are made is usually paper or a plastic composite. However, to function also as a drinks mat, the folding cards can be made out of an absorbent material, e.g. Dalton Drinks Coaster Blotting. Preferably the affixing means is then Gripit 5726. This combination of material and adhesive achieves not only effective drinks mats, but also effective inter-ply adhesive strength, good foldability and good durability. Also a tidy surface finish is achieved since the adhesive does not seep too deeply into the material. Although a variety of different adsorbent materials and adhesives might be used, many combinations result in unsatisfactory appearances for the finished product, or unsatisfactory foldability or durability.

Figure 6:
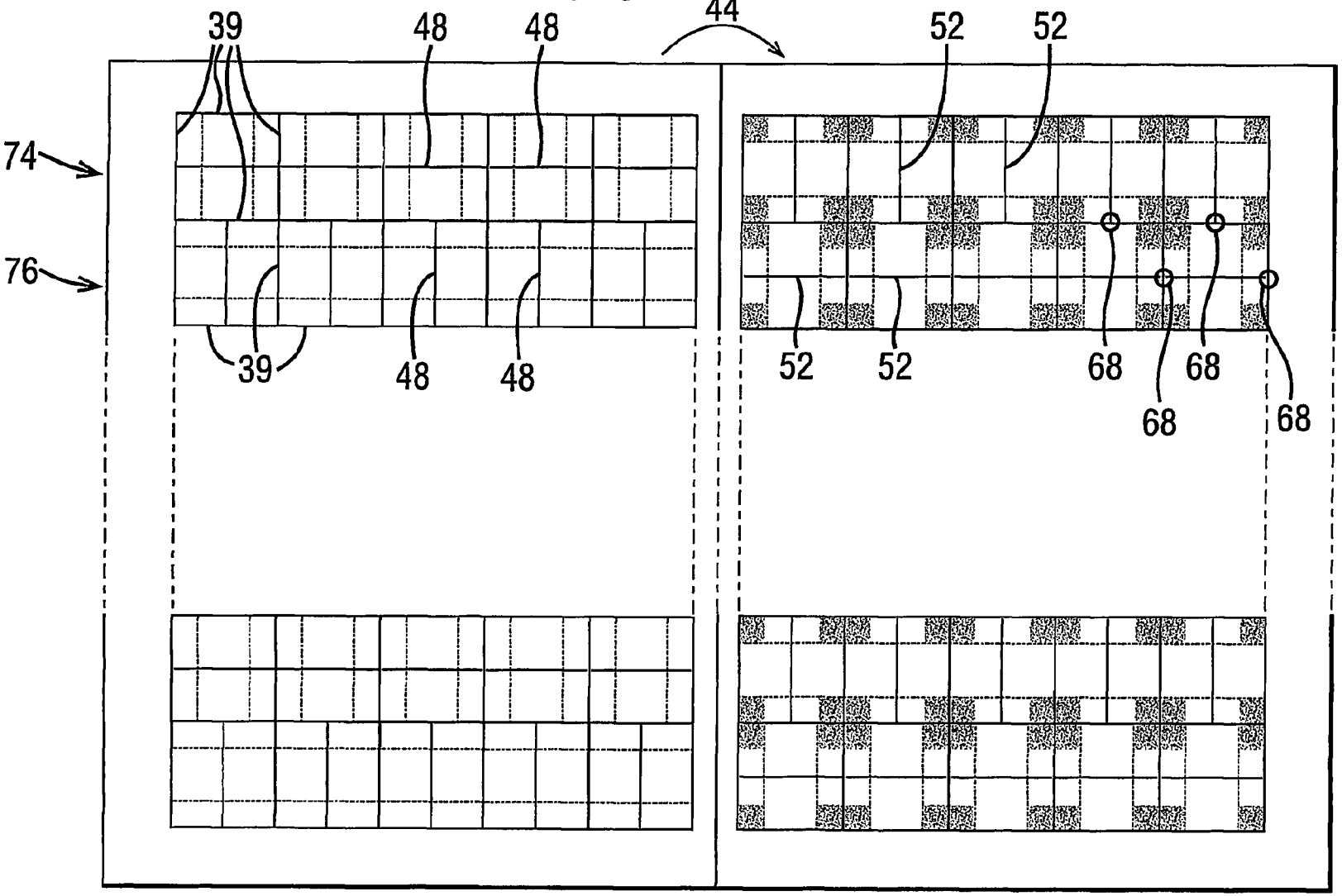
FIG. 6 shows a sheet not in accordance with the present invention for forming a plurality of folding cards.

Referring now to FIG. 6, a sheet 70 for forming folding cards not in accordance with the present invention is disclosed. The folding cards are formed in much the same way as when formed using the sheet of FIG. 3. However, there are a number of differences in the arrangement of the plies thereon. Further, the plies shown are for making square folding cards, not hexagonal ones.

Instead of the individual plies being spaced apart relative to each other, the plies are arranged in touching relationship. Since the folding cards are intended to be square, the perpendicular cut lines 48, 52 would normally extend to the edges of the plies. However, since the plies are not in touching relationship with a neighbouring ply, this would result in a continuous cut extending throughout almost a half length of the sheet 70. For this reason, the perpendicular cut lines do not quite extend the full width or length of the plies, leaving a small spacing 68 at each end thereof. The spacings 68 are more clearly shown in FIG. 20.

An additional benefit of these spacings is that the finished folding cards, once cut from the folded sheet 70, will be lightly restrained from undergoing a first fold of the four step cyclic series of folds. The slight spacing 68 provides a breakable "seal", which, if made small, will easily be broken by a user when an attempt to first fold the folding card is made.

Despite these spacings 68, the integrity of the sheet 70 is still weakened by the presence of the long cut lines. For this reason, alternate strips 74, 76 of plies have the plies arranged orthogonally to the adjacent strip. Other orientations can be used with other folding card shapes and sizes. Further, it need not be the entire strip that is differently arranged, but instead just individual plies (and its corresponding ply). When the rip-offs of FIGS. 1 to 3 are provided, however, there is no need for these spacings. The rip-offs provide spacings.

Referring now to FIG. 7, a variant of the sheet shown in FIG. 6 is shown. On this sheet, which is not in accordance with the present invention, there are two fold lines 64. The first fold 44 about its fold line 64 forms a first array of folding cards. The second fold 45 about its fold line 64 forms a second array of folding cards. By reducing the size of the flaps being folded, a smaller folding unit can be used.

The number of folding cards formed by each fold need not be the same. In FIG. 7, the first fold forms a four card wide array. The second fold forms a five card wide array.

Figure 9:
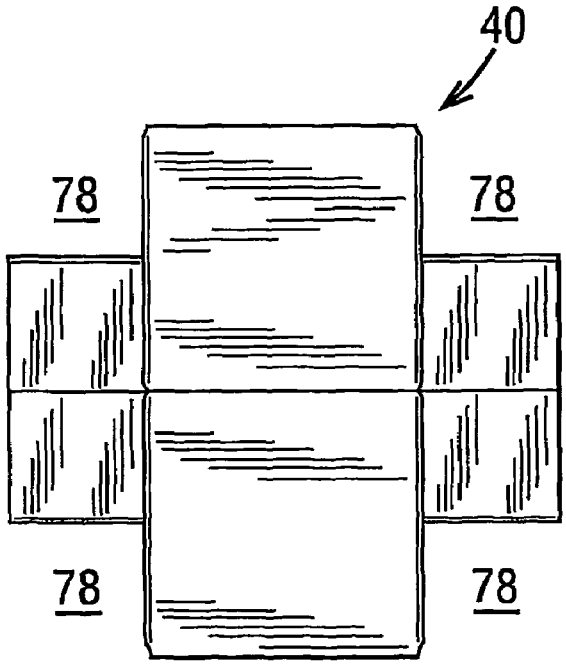
FIG. 9 Prior art
FIG. 9 shows the folding card of FIG. 8 after the second fold in a four fold cyclic series of folds.
Figure 10:
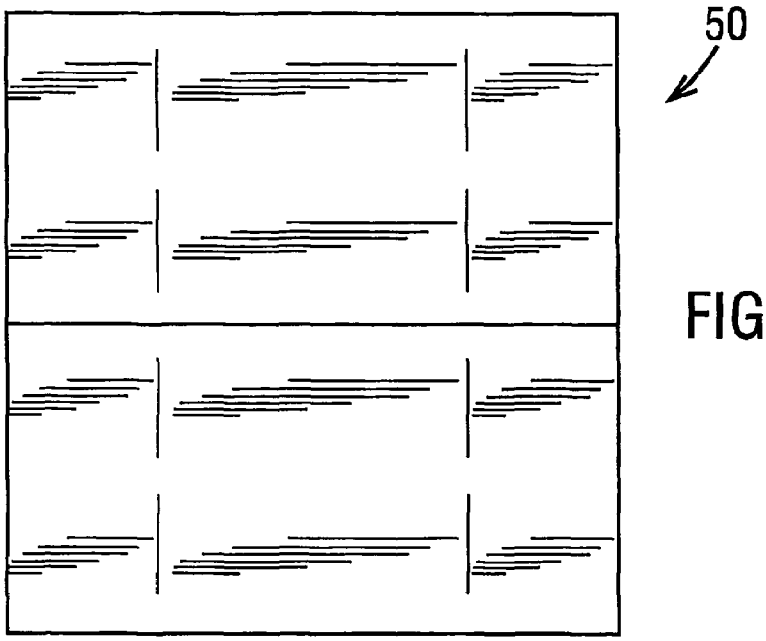
FIG. 10 is shows a folding card in accordance with the first aspect of the present invention in an initial, unfolded state.
Figure 11:
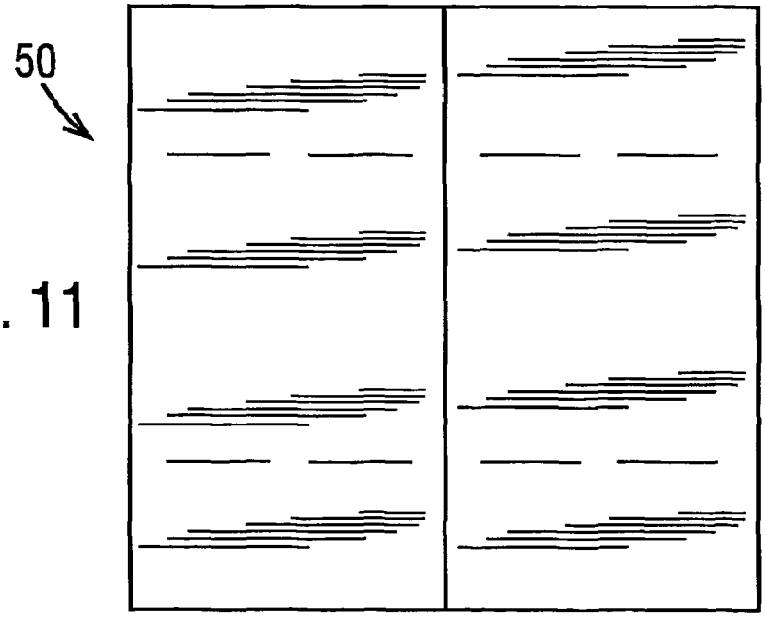
FIG. 11 is a rear view of the folding card of FIG. 10.
Figure 12:
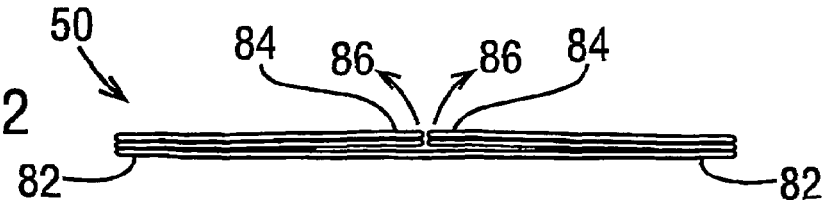
FIG. 12 is a side elevation of the Folding card of FIG. 10, with the thickness of each ply exaggerated.
Figure 13:
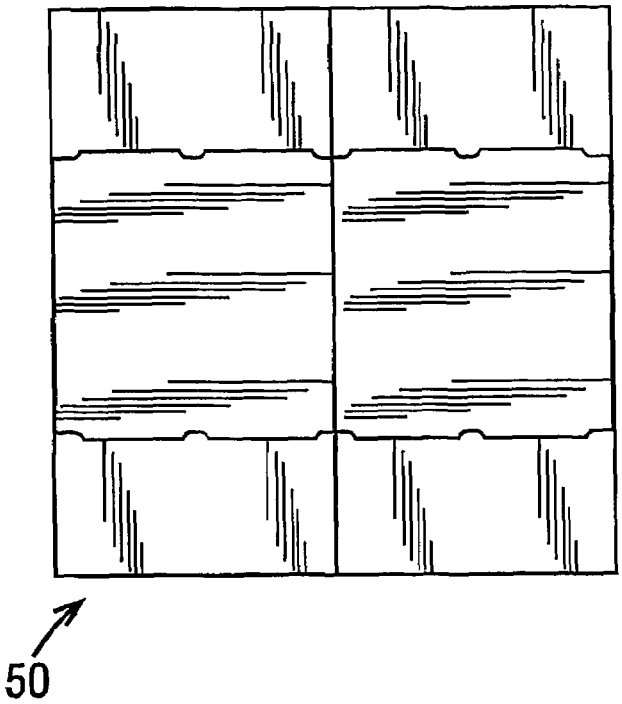
FIG. 13 shows the front of the folding card of FIG. 10 after a first fold.
Figure 14:
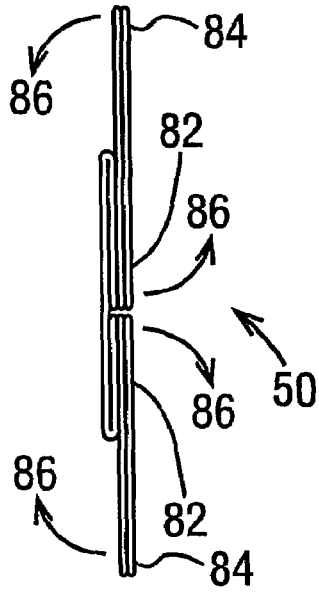
FIG. 14 is a side elevation of the folding card in FIG. 13 with the thickness of each ply exaggerated.
Figure 15:
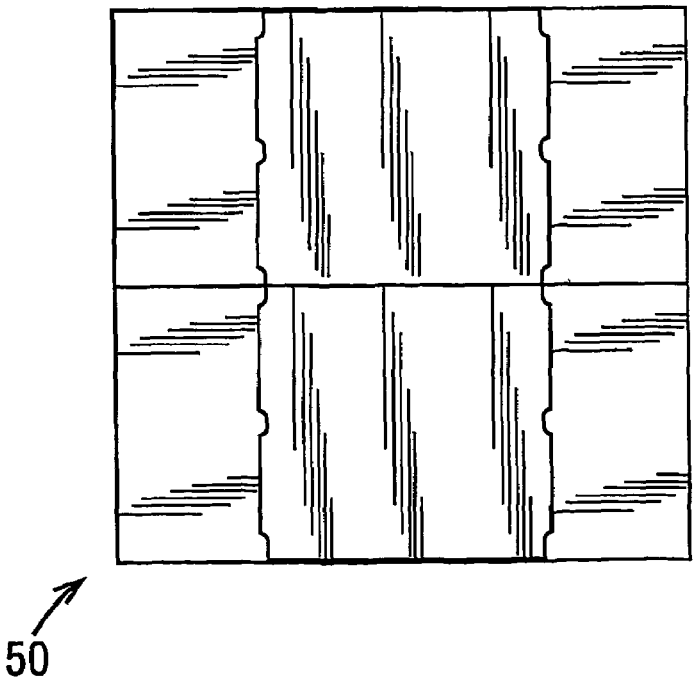
FIG. 15 shows the front of the folding card of FIG. 10 after a second fold.
Figure 16:
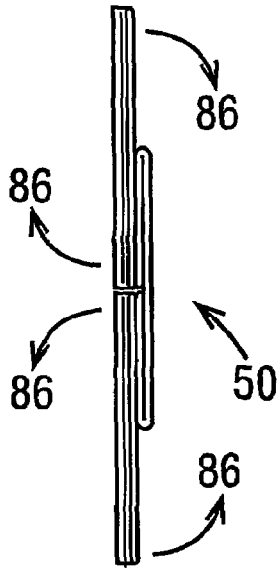
FIG. 16 is a side elevation of the folding card in FIG. 15 with the thickness of each ply exaggerated.
Figure 17:
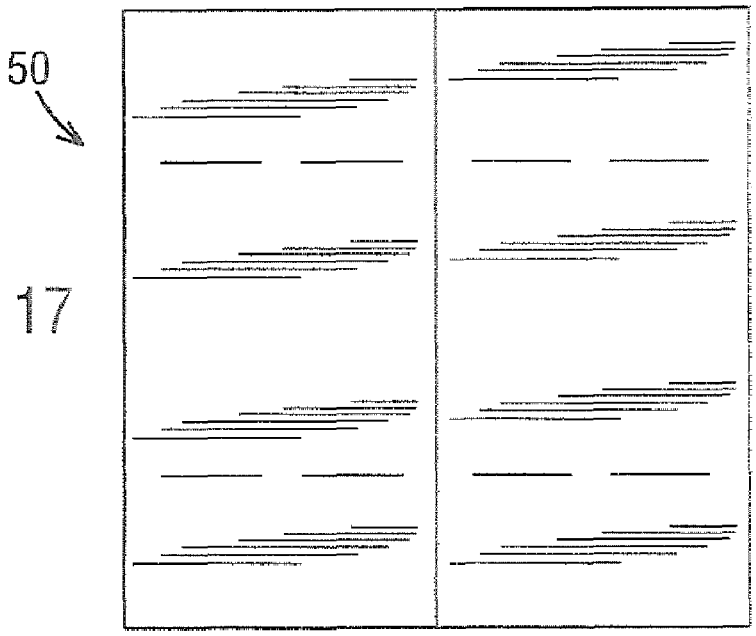
FIG. 17 shows the front of the folding card of FIG. 10 after a third fold.
Figure 18:
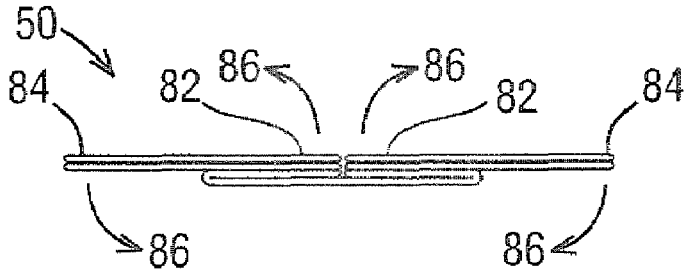
FIG. 18 is a side elevation of the folding card in FIG. 17 with the thickness of each ply exaggerated.
Figure 19:
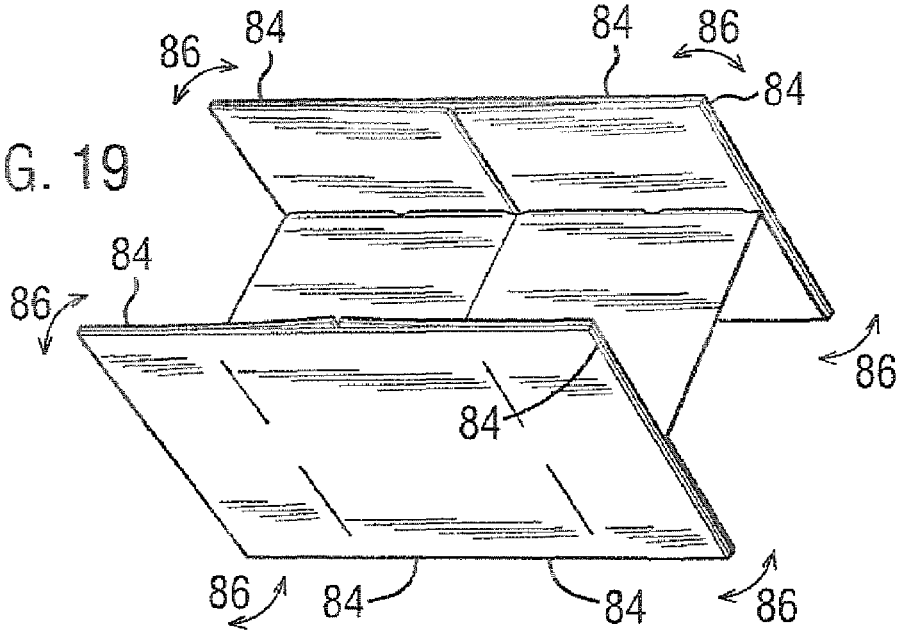
FIG. 19 is a perspective view of the folding card of FIG. 10 in an intermediate folded state between the initial state and the first folded state.

Referring now to FIG. 9, a prior art folding card is shown in the state reached after completion of the second fold in the cyclic series of folds thereof. As can be seen in the Figure, the folding card becomes cross-shaped. This means that the four corner portions 78 are no longer available for printed matter. Referring to FIGS. 10 to 19, a folding card 50 according to the first aspect of the present invention is shown that does not suffer from this problem. As can be seen in FIG. 15, the state of the folding card 50 following the second fold is still square.

As shown in FIGS. 12, 14, 18 and 19, this is achieved by making the folding card from three plies. FIGS. 20 and 21 show a blank 80 and a sheet 90 for forming such three-ply folding cards 50.

Referring to FIGS. 12, 14 18 and 19, the folding card can be folded 86 in the same four fold cyclic manner as the prior art folding cards.

Still referring to FIGS. 12, 14 18 and 19, the three plies are adhered together as a three-ply sheet in select positions 82 of the folding card 50. In other positions 84, the plies are only secured together as two-ply, and in other positions they are separate plies. Two methods of achieving this will now be described with reference to FIGS. 20 and 21.

FIG. 20 shows a blank 80. Many features correspond with those from FIGS. 1 to 3, 6 and 7. For example there is a first ply 34, a second ply 36, each having perpendicular cut lines 48, 52 and folding card folding lines 46. A border 32 surrounds the plies, although the plies could be positioned with smaller borders, or there could be no border between the plies to bring it into accordance with the third aspect of the present invention. Adhesive 56 is also provided at select positions of the second ply 36. However, the blank 80 comprises a number of new features.

Firstly, a third ply 88 is provided. This ply has a perpendicular cut line 48 and folding card fold lines 46 corresponding with the ones on the first ply 34. However, the third ply has adhesive 92 thereon. Also, the second ply has additional adhesive positions 92.

The adhesive 56, 92 on the blank 80 for the three layer folding card 50 substantially fills the areas of the second and third plies 36, 88 outward from the folding card folding lines 46. However, four discrete sections of adhesive 56, 92 are shown in the Figures to reduce the amount of adhesive 56, 92 used.

To form the folding cards 50 in accordance with the first aspect of the present invention, the method of the second aspect of the present invention is used. Firstly, the first ply 34 is folded 44 over the second ply 36 about a first fold line 64. Secondly, the third ply 88 is folded 45 about a second fold line 64 over the first ply 34 to sandwich the first ply 34 between the third ply 88 and the second ply 36. The folded blank 80 is pressed together to ensure the adhesive bond between adjacent plies is effected and then the folding card 50 is cut or stamped from the folded blank 80.

A plurality of these blanks 80 may be provided on a sheet. Alternatively, the plies may be arranged in arrays as in FIG. 6.

Referring now to FIG. 21, a sheet 90 for forming a plurality of three-ply folding cards 50 is shown. The principle of use is substantially similar to that of a single blank. However, the individual plies are arranged in an array, in much the same manner as in FIG. 6. Further description of this sheet 90, and its use in manufacturing folding cards 50, is therefore not required.

A skilled person in the art of paper model manufacturing will appreciate that the blank 80 or sheet 90 for the three-ply folding cards could be otherwise folded; the first and second folds 44, 45 could position the first and third plies on opposite sides of the second ply (the positioning of the adhesive could then be changed, for example to either side of the second ply). Such changes would also require the orientation of the perpendicular cut line 48 and folding card fold lines 46 of either the first or the third ply to be altered by 90°. The present invention has been described above purely by way of example. It should be noted that modifications in detail may be made within the scope of the invention.

The invention claimed is:

1. A folding card that can be folded in half repeatedly through a repeating series of four folds, each of the four folds resulting in one of four folded, yet substantially flat, states for the folding card, each presenting a face for the folding card, the repeating series of four folds presenting a repeating series of four logos, texts or pictures, one of which is on each of those four presented faces of the folding card; wherein:

each fold comprises folding the folding card in half about two parallel, spaced-apart fold lines, the parallel fold lines in each sequential fold being perpendicular to the parallel fold lines in the preceding and subsequent folds, such that the logo, text or picture presented on the existing face of the folding card is broken in half to reveal from underneath it the next logo, text or picture in the repeating series of logos, texts or pictures on the resulting face of the folding card;

the folding card comprises in its initial, unfolded state, three stacked plys of sheet material with the three plys being stacked one above the other and selectively adhered together such that:

the three plys are all adhered together as a three-ply thick sheet in four select positions of the folding card, at eight other select positions just two of the three plys are adhered together, and at all other positions the three plys are stacked without being glued together at all, whereby each fold will comprise folding the folding card such that parts of one ply separate from parts of another ply over which they are overlaid but not adhered to; and in each folded, yet substantially flat, state of the folding card, a cross shape in plan view is not presented as the outline of the folding card.

2. The folding card of claim 1, wherein one or more of the plys comprises a multi-layer sheet.

3. The folding card of claim 1, wherein the folding card comprises a single sheet, folded twice, the two folds forming the three plys.

4. The folding card of claim 1, wherein the folding card is formed from an absorbent material.

* * * * *